US006406389B1

(12) United States Patent
Feeney et al.

(10) Patent No.: US 6,406,389 B1
(45) Date of Patent: Jun. 18, 2002

(54) BASKETBALL HAVING A CARCASS WITH SEAM AREAS

(75) Inventors: Brian Feeney, Enfield, CT (US); Ronald P. LaLiberty, Dudley; Raymond A. Long, South Hadley, both of MA (US)

(73) Assignee: Spalding Sports Worldwide, Inc, Chicopee, MA (US)

( * ) Notice: Subject to any disclaimer, the term of this patent is extended or adjusted under 35 U.S.C. 154(b) by 0 days.

(21) Appl. No.: 09/476,855

(22) Filed: Jan. 3, 2000

Related U.S. Application Data

(60) Provisional application No. 60/120,837, filed on Feb. 19, 1999.

(51) Int. Cl.[7] ..... A63B 41/08
(52) U.S. Cl. ..... 473/604; 473/596
(58) Field of Search ..... 473/604, 605, 473/607, 608, 609, 599, 596

(56) References Cited

U.S. PATENT DOCUMENTS

| | | | | | |
|---|---|---|---|---|---|
| 2,214,179 | A | * | 9/1940 | Reach | 473/604 |
| 2,280,314 | A | * | 4/1942 | Scudder | 473/604 |
| 3,256,019 | A | | 6/1966 | Barton | |
| 3,506,265 | A | * | 4/1970 | Yugi | 473/604 |
| 3,508,750 | A | * | 4/1970 | Henderson | 473/605 |
| 3,512,777 | A | | 5/1970 | Henderson | |
| 5,681,233 | A | | 10/1997 | Guenter et al. | |
| 6,022,283 | A | * | 2/2000 | Schindler et al. | 473/605 |
| 6,099,423 | A | * | 8/2000 | Ou | 473/604 |
| 6,123,633 | A | * | 9/2000 | Guenther et al. | 473/604 |
| 6,206,795 | B1 | * | 3/2001 | Ou | 473/604 |

* cited by examiner

*Primary Examiner*—Steven Wong

(57) ABSTRACT

A basketball formed from overlying layers includes a carcass layer with recessed curvilinearly extending seam areas. Ribs longitudinally follow the recessed seam areas and extend outwardly therefrom. Panels are mounted to the carcass between the ribs.

6 Claims, 2 Drawing Sheets

BASKETBALL HAVING A CARCASS WITH SEAM AREAS

CROSS-REFERENCE TO RELATED APPLICATION

This application claims the benefit of U.S. Provisional Application No. 60/120,837, filed Feb. 19, 1999.

FIELD OF THE INVENTION

The present invention relates generally to basketballs and more particularly to basketballs of the type comprising laminated construction.

BACKGROUND OF THE INVENTION

A large number of high quality basketballs feature laminated construction. Typically these basketballs are comprised of a multi-layer structure which includes a generally spherical interior air bladder wound with monofilament strands to create a winding layer overlying the air bladder. A cellular elastomer layer may optionally be formed over the winding layer. A carcass is formed over the winding layer, or cellular layer if present. The carcass is of uniform thickness defining a substantially spherical outer surface with a carcass circumference. A plurality of ribs project outwardly from the carcass outer surface and extend curvilinearly around the carcass outer surface. Typically, the ribs are raised about 0.51–0.89 mm above the carcass circumference. The carcass area between the ribs defines a plurality of separated surface areas. Traditionally, the carcass is divided into eight surface areas in simulation of the eight sewn together panels of a traditional leather covered basketball. Panels are laminated onto the outer surface of the carcass in the separated surface areas. The thickness of the panels is greater than the thickness of the ribs, so that the ribs, while projecting above the carcass surface, are recessed below the panel exterior surface. The edge portions of the panels are beveled or "skived" so that the panel edge will be flush with the projecting carcass rib when laminated. When finished, the traditional laminated basketball has a spherical shape, with the carcass rib and opposing skived panel edge portions defining a panel seam area. Typically, panel seam areas are 2.54–6.35 mm wide. From an aesthetic standpoint, this configuration for a basketball cover has gained wide acceptance.

In addition to the aesthetic aspect, panel seam areas also serve a functional purpose. One aspect of ball control is the ability to readily impart a desired amount of backspin to the ball when it is passed or when a basket is attempted. Imparting backspin is considered to be of high importance in helping direct a ball into the basket which first makes contact with the backboard or rear portion of the hoop of the basketball goal. In this instance backspin is converted into downward motion of the ball upon making contact, thereby urging the ball into the goal. The skilled player thus strives to place their fingers and/or thumbs in the panel seams to obtain greater leverage for imparting such backspin and therefore superior control of the ball.

In the course of play it is preferable for the person handling the ball to locate the panel seams using tactile input alone. With a traditional laminated basketball, the shallowness and narrow width of the seams makes them difficult to locate by touch. Of course, the player can look directly at the ball to determine orientation of the panel seams. However the frenetic pace of the game requires continuous visual monitoring and observation of both teammates and opposing players, making even an occasional glance at the ball a serious disruption in a player's concentration.

SUMMARY OF THE INVENTION

An object of the present invention is to provide a basketball of laminated construction having a seam area which is easier to find and use during play.

Another object of the present invention is to provide a laminated basketball which affords increased control compared to traditional laminated basketballs.

Other objects will be in part obvious and in part pointed out more in detail hereinafter.

These and related objects are achieved by providing a laminated basketball comprising a spherical interior air bladder which is over wound with monofilament strands. A carcass is formed over the wound bladder. The formed carcass includes a plurality of channels extending curvilinearly around the carcass and recessed below the carcass outer surface. The carcass outer surface between the channels defines a plurality of panel areas. The carcass is of substantially equal thickness in the panel areas. The carcass thickness directly under the channel is less than the carcass thickness in the panel areas. A rib projects outwardly from each channel. The carcass thickness in the area transversely disposed from the ribs gradually changes from a lesser thickness at the channel to a greater thickness in the panel area. The exterior face of the rib is flush with or below the carcass circumference.

Panels are bonded or laminated in the panel areas. The panels are bounded by the ribs formed in the carcass. The panels are skived and/or follow the tapered surface of the channel, so that the skived panel edge is substantially flush with the exterior face of the rib. The resulting basketball will define a novel panel seam area which is recessed further below the surface and may be wider when compared to traditional laminated basketballs.

In a different embodiment, the inventive laminated basketball comprises a layer of cellular elastomer formed over the winding layer. The cellular layer includes recessed areas curvilinearly extending around its surface. The carcass is of substantially equal thickness and is formed over the cellular layer, with the projecting carcass ribs preferably centrally located with respect to the cellular layer recessed areas. The resulting basketball will also define a novel recessed and wider panel seam area when compared to traditional laminated basketballs.

The inventive recessed panel seam area is of sufficient depth and width to provide for improved tactile indicia of its location and orientation. In addition, the recessed panel seam area provides an enlarged contact surface for the player's fingers and thumbs to act against for imparting backspin when shooting or passing the ball. Thus, the novel recessed panel seam area is easier for a player to find and use and allows for greater accuracy of the thrown ball.

BRIEF DESCRIPTION OF THE DRAWINGS

Other objects and advantages of the invention will be evident to one of ordinary skill in the art from the following description and Figures, in which.

DETAILED DESCRIPTION OF THE INVENTION

Figure 2:
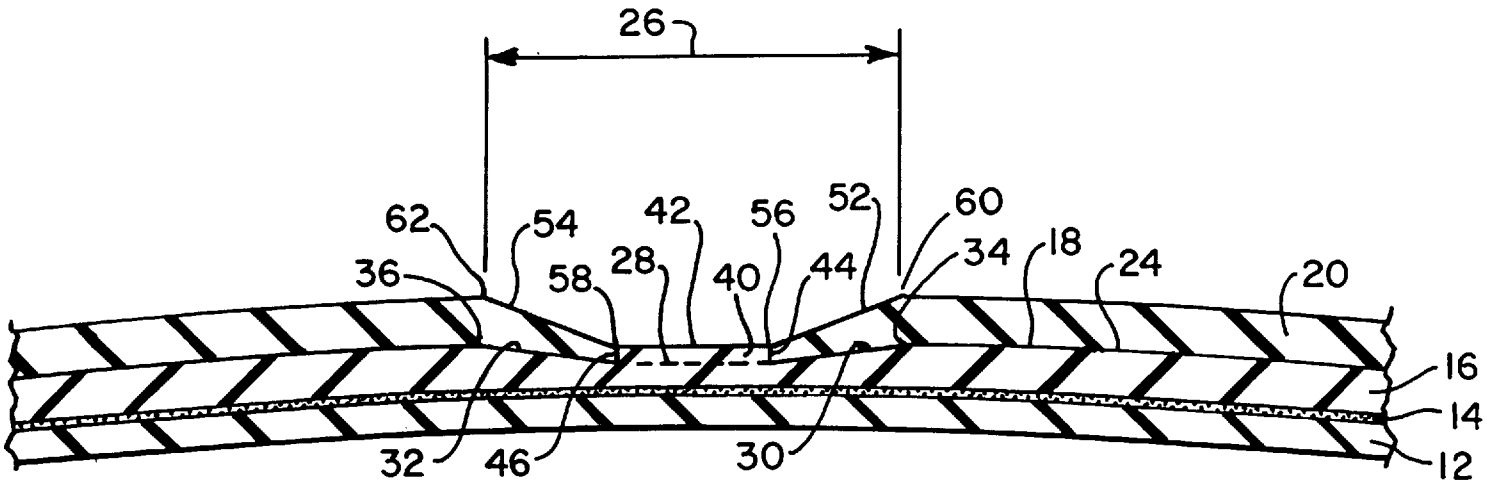
FIG. 2 is a cross-sectional view of a broken away portion of an embodiment of the inventive laminated basketball.

A basketball constructed in accordance with the principles of one embodiment of the present invention, generally indicated by the numeral 10, can readily be understood with reference to FIG. 2. Such basketball is made up generally of four major components: an interior air bladder 12, a layer 14 of monofilament strands wound over the bladder, a carcass 16 formed over the wound layer defining panel areas 18 and panels 20 secured in the panel areas 18.

More specifically, the bladder 12 is formed spherically and adapted to be inflated with air. The bladder 12, when properly inflated, provides the primary resilience for the finished basketball 10. The preferred material for the bladder is principally synthetic butyl rubber as is conventional for high quality basketballs, but may include about 15% natural rubber.

Outwardly disposed of the interior air bladder is a layer 14 comprising monofilament polymeric strands, preferably of nylon or polyester. The strands are coated with an adhesive (not shown), preferably a rubber cement, to ensure retention of the strands on the bladder as is conventional. The winding layer 14 adds dimensional stability to the bladder 12 and ball 10, restrains outward expansion when inflated and also reduces outward pressure on the carcass 16.

The next exterior most layer of the basketball 10 is an elastomer carcass 16. The carcass 16 has a substantially spherical outer surface 24 defining a carcass circumference. A plurality of curvilinearly extending channels 26 are recessed below the carcass circumference. Preferably, each channel 26 includes a channel floor 28 and opposing inclined channel sides 30, 32 connecting the channel floor 28 to the carcass surface 24. The channel side 30, 32 meets the carcass surface 24 at a shoulder 34, 36, respectively. Thus the channel 26, and naturally the channel width, are defined by the opposing shoulders 34, 36.

A rib 40 projects from the channel floor 28, is preferably centered within the channel 26 and curvilinearly extends around the carcass 16 with the channel 26. Preferably, the exterior face 42 of the rib 40 is flush with or below the carcass circumference. Spaced sides 44, 46 preferably parallel, connect the rib face 42 to the channel floor 28. It should be noted that while the carcass channel 26 and rib 40 are described separately for clarity, in practice the carcass 16 will be formed as an integral portion including panel areas 18, channels 26 and ribs 40 around the wound layer 14. The carcass surface 24 between the channels 26 defines the plurality of panel areas 18.

While not shown, a channel having non-linear channel sides, non-linear rib sides, non-linear rib face or radiused shoulders is fully encompassed by this invention.

The carcass 16 has a thickness in the range of about 0.5 to 1.5 millimeters (mm) and a preferred range of about 0.8 to 1.2 mm over the majority of the panel areas 18. The carcass 16 has a thickness in the range of about 0.4 to 0.8 mm and a preferred range of about 0.5 to 0.7 mm under the rib 40. The rib 40 has a thickness in the range of about 0.3 to 0.8 and a preferred range of about 0.5 to 0.7 mm. Thus the resulting thickness of the rib 40 and carcass 16 is in the range of about 0.7 to 1.6 mm with a preferred range of about 1.0 to 1.4 mm. The carcass thickness decreases transversely from the shoulder 34, 36 to the rib 40. Thus, the carcass 16 (without taking into account the projecting rib itself) is preferably thinnest directly under the rib 40, thickest in the panel areas 18 and gradually increases in the transverse direction from the rib to the panel area. The carcass 16 may comprise an integral cellular portion (not shown) adjacent the winding layer 14.

The preferred material for the carcass 16 is a natural rubber compound. The carcass 16 is preferably formed of two hemispheres separated at an equator line, which are preferably molded over the winding layer 14. The molding of the carcass hemispheres onto the winding layer forms a unitary, seamless carcass 16 comprising the channels 26, ribs 40, panel areas 18 and variable thickness therebetween and also causes the carcass material to flow into and around the strands of the winding layer 14 for a secure mechanical bond.

Figure 1:
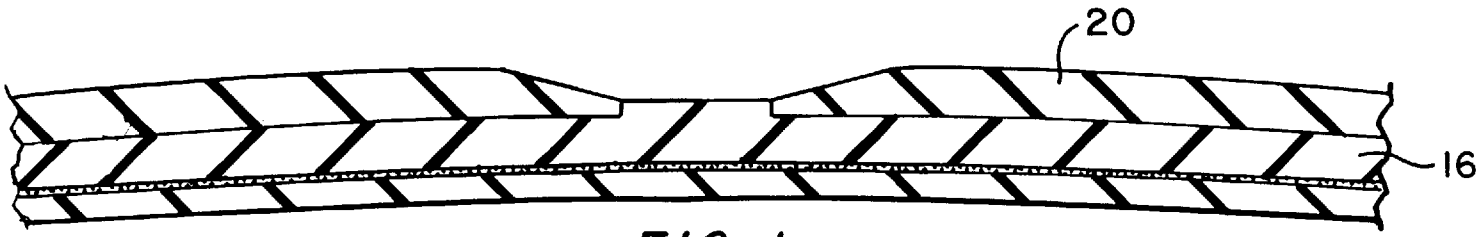
FIG. 1 PRIOR ART
FIG. 1 is a cross-sectional view of a broken away portion of a prior art laminated basketball.

The exterior most cover of the basketball 10 is formed of discrete panels 20. The panels 20 are first cut to a shape to fit within the panel areas 18 between the ribs. Edge portions 52, 54 of the panels 20 are beveled or skived from a shoulder 60, 62 to a panel edge 56, 58 respectively. The panel edges 56, 58, when laminated, will be adjacent a rib side 44, 46 and generally flush with the rib exterior face 42. The panel edge portions 52, 54 will also follow the recessed sides 30, 32 of the channel. An adhesive, preferably a contact cement such as styrene butadiene, holds the panels 20 in place to the panel areas 18. Opposing panel shoulders 60, 62, panel edge portions 52, 54 and rib 40 define a panel seam area. The inventive recessed channel 26 in the carcass 16 allows the panel seam area to be wider and recessed further below the basketball exterior when compared to a traditional basketball of laminated construction as shown in FIG. 1.

Figure 3:
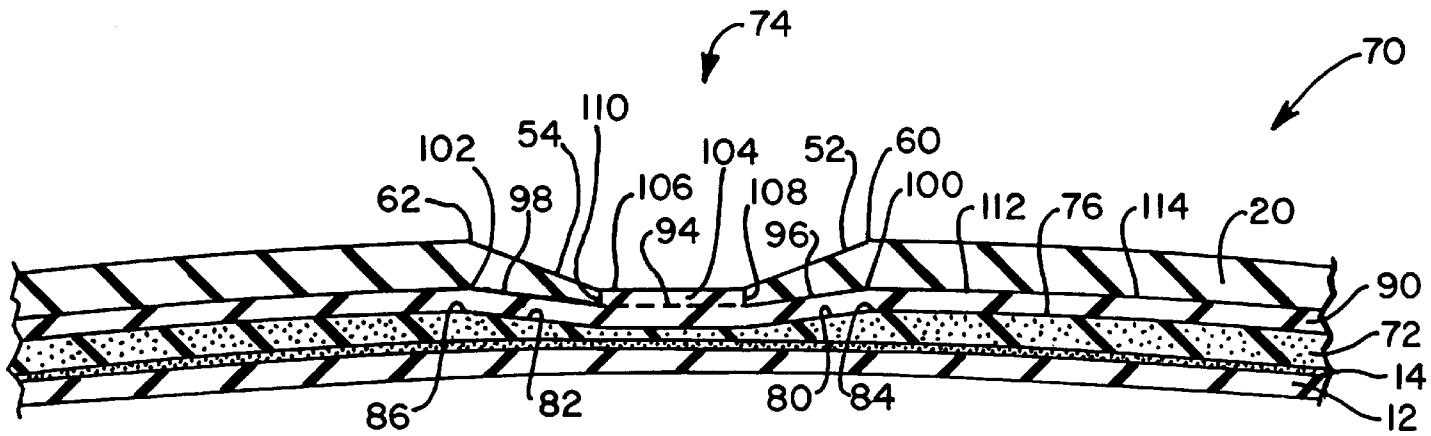
FIG. 3 is a cross-sectional view of a broken away portion of a different embodiment of the inventive laminated basketball.

In FIG. 3 a different embodiment of the present invention is shown, wherein the basketball 70 includes an air bladder 12, a layer of windings 14 overlying the bladder 12 and a cellular layer 72 overlying the winding layer 14. The cellular layer 72 is preferably comprised of a natural rubber compound. The cellular layer 72 has a density in the range of 0.5 to 1.1 g/cm$^3$.

A plurality of recessed channels 74 extend curvilinearly around the cellular layer outer surface 76. The channels 74 include a channel floor 78 and channel sides 80, 82 connecting the floor 78 to opposing shoulders 84, 86 on the cellular layer outer surface 76. The cellular layer 72 has a substantially uniform panel area thickness in the range of 1.0 to 1.7 mm, with a range of 1.5 to 1.7 mm being preferred. The cellular layer 72 has a thickness in the range of about 0.7 to 1.0 mm and a preferred range of about 0.8 to 0.9 mm in the floor 78. The cellular layer 72 thickness in the channels 74 changes transversely from the edge of the floor 78 to the shoulders 84, 86.

A carcass 90 with a uniform thickness is formed over the cellular layer 72. The carcass 90 has a thickness in the range of about 0.5 to 1.3 mm and a preferred range of about 0.8 to 1.0 mm. The carcass 90 follows the cellular layer sides 80, 82 and floor 78 to create a carcass channel 92 with a floor 94, sides 96, 98 and shoulders 100, 102 which overlap those of the cellular layer The carcass 90 includes exteriorly projecting ribs 104 which are preferably centrally located with respect to the recessed channels 92. The rib 104 has a thickness in the range of about 0.3 to 0.8 mm and a preferred range of about 0.5 to 0.7 mm. Thus the resulting thickness of the rib 104, carcass 90 and cellular layer 72 is in the range of 1.5 to 3.1 mm with a preferred range of about 2.1 to 2.6 mm. As previously described, each rib 104 includes an exterior face 106 and spaced sides 108, 110 connecting the face 106 to the carcass floor 94. The carcass surface 112 between the ribs 104 defines a plurality of panel areas 114. The outer surface 112 of the carcass defines a carcass circumference. Skived panels 20 are bonded to the carcass 90 in the panel areas 114 as previously described, with the panel edge portions 52, 54 and rib 104 defining the recessed seam area. Although not shown, it would also be foreseeable to create the recessed seam area by using a cellular layer and a carcass each having overlapping recessed portions.

Figure 4:
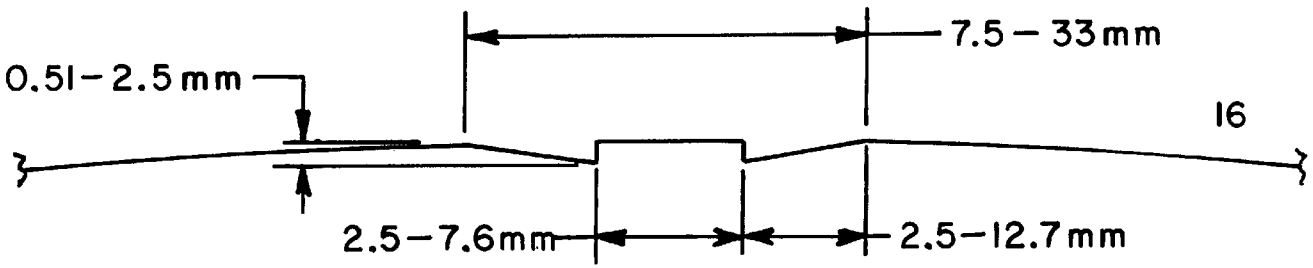
FIG. 4 is a diagrammatic view of a panel seam area of the inventive laminated basketball.

As illustrated in FIG. 4, in either embodiment, the exteriorly projecting face 42, 106 of the carcass rib is preferably flush with or below the carcass circumference. The depth of the recessed area from the carcass channel floor 28, 94 to the carcass shoulder 34, 100 is within a range of about 0.5 to 2.5 mm, with a range of 0.6 to 1.0 mm being preferred. The width of the rib 40, 104 is within the range of 2.5 to 7.6 mm, with a standard width of about 4.7 mm. The distance from the shoulder 34, 100 to the adjacent rib side 44, 108 is within the range of about 2.5 to 12.7 mm with a typical distance of about 4.5 mm. Thus, the overall width of the recessed seam area, from one carcass shoulder 34, 100 to the opposing shoulder 36, 102, is within the range of 7.5 to 33 mm, with a typical recessed seam area width of 13.7 mm.

The ball of the present invention may be produced largely in a conventional manner. Accordingly, the air bladder 12 of the ball would be inflated to an appropriate size and preferably cooled to cause the material of the bladder to become somewhat rigid. In this rigid condition, the air bladder 12 is wound with adhesive coated polymer threads. The air bladder 12 with the overlying layer of windings 14 is then placed in a mold in which the carcass hemispheres are arrayed. The mold is closed and sealed and optionally the air bladder is inflated to help the bladder make full contact with the carcass materials within the mold, and heat and pressure are applied to cause the rubber of the carcass to cure and vulcanize and become securely attached to the air bladder 12 and winding layer 14. The molding process further forms the structure of the carcass 16, 90 including channels 26, 92, ribs 40, 104 and panel areas 18, 114.

Individual panels 20 are formed to fit over the surface of the carcass within the panel areas 18, 114 defined by the formed ribs 40, 104. The edge portion 52, 54 of each panel is skived or tapered. When a skived panel edge 58 is correctly positioned abutting a rib 40, 104, the panel edge will be adjacent a rib side and substantially flush with the outwardly projecting rib face 42, 106.

In the case of a ball with a cellular carcass portion or layer 72, the cells are typically produced by adding a blowing agent to the raw material. Different concentrations of blowing agent will change the density of the molded cellular layer. Such blowing agents are exemplified by Celogen TSH available, from Uniroyal Chemical, Middlebury, CT USA. The cellular layer 72 is typically formed around the substructure formed by the air bladder 12 and the winding layer 14 in a molding process, wherein the bladder/winding substructure is placed in a mold and the cellular layer material in a non-expanded state is molded around the substructure. The heat of the molding operation causes the blowing agent to expand. The end result of the molding operation is a unitary structure with a cured, cellular layer of a desired density molded over the winding layer. The thickness of the cellular layer is governed by the space between the bladder/winding substructure outer diameter and the mold inner diameter. The structure thus formed is placed in a second mold and the carcass hemispheres are molded over the cellular layer 72.

Subsequently, the completed ball is taken from the mold and flash from the molding process is trimmed from the ball. The ball is then in condition for the application of decals, paint or other decorative or informative markings.

As will be apparent to persons skilled in the art, various modifications and adaptations of the structure described above will become readily apparent without departure of the spirit and scope of this invention.

What is claimed is:

1. A laminated basketball, comprising:

a bladder;

a winding layer around said bladder;

a carcass with an inner face adjacent said winding layer and an outer face, said carcass including a plurality of curvilinearly extending channels each having an outwardly extending rib with sides and an exteriorly projecting face, said channels defining a plurality of panel areas, said carcass comprising an inner layer with a greater thickness in said panel areas tapering to a lesser thickness in said channels and an outer layer with a substantially equal thickness except where said rib defines a greater thickness; and a plurality of panels each laminated to the outer face of said carcass in one said panel area.

2. The basketball of claim 1 wherein said carcass inner layer comprises a cellular material.

3. The basketball of claim 1 wherein the difference between said first thickness and said second thickness is within the range of 0.5 to 2.5 mm.

4. The basketball of claim 1 wherein said channels each have a channel shape with a floor and obliquely angled sides.

5. The basketball of claim 4 wherein said carcass tapers from said first thickness to said second thickness over a distance within the range of 2.5 to 12.7 mm.

6. The basketball of claim 1 wherein said carcass comprises a cellular inner portion.

* * * * *